United States Patent [19]

Machu

[11] Patent Number: 4,632,145

[45] Date of Patent: Dec. 30, 1986

[54] LIFTING DEVICE FOR THE CLOSURE PLATE OF COMPRESSOR VALVES

[75] Inventor: Erich H. Machu, Vienna, Austria

[73] Assignee: Hoerbiger Ventilwerke Aktiengesellschaft, Vienna, Austria

[21] Appl. No.: 680,336

[22] PCT Filed: Mar. 2, 1984

[86] PCT No.: PCT/AT84/00011

§ 371 Date: Nov. 1, 1984

§ 102(e) Date: Nov. 5, 1984

[87] PCT Pub. No.: WO84/03542

PCT Pub. Date: Sep. 13, 1984

[30] Foreign Application Priority Data

Mar. 3, 1983 [AT] Austria ..... 743/83

[51] Int. Cl.[4] ..... F16K 15/08

[52] U.S. Cl. ..... 137/516.21; 137/517; 417/298; 417/299; 417/447

[58] Field of Search ..... 137/516.17, 516.19, 137/516.21, 517; 417/298, 299, 447

[56] References Cited

FOREIGN PATENT DOCUMENTS

| | | | |
|---|---|---|---|
| 923082 | 6/1954 | Fed. Rep. of Germany . | |
| 1190601 | 4/1959 | Fed. Rep. of Germany | 417/298 |
| 1114975 | 10/1961 | Fed. Rep. of Germany . | |
| 1267777 | 5/1968 | Fed. Rep. of Germany . | |
| 1953506 | 4/1971 | Fed. Rep. of Germany . | |
| 764821 | 1/1957 | United Kingdom | 417/298 |

*Primary Examiner*—Robert G. Nilson

*Attorney, Agent, or Firm*—Watson, Cole, Grindle & Watson

[57] ABSTRACT

A lifting device for controlling the movement of the closure plate of a compressor valve comprises a first gripper part which is connected to the compressor valve to be movable toward and away therefrom; a regulating spring which is in contact with the first gripper part to bias it toward the compressor valve; and a second gripper part which is movable with respect to the first gripper part and the compressor valve, the second gripper part including lift elements having lifting prongs which can contact the closure plate, tension screws which connect the lift elements to the first gripper part and provide end stops for the movement of the lift elements, and damper springs which damp the relative movement of the lift elements relative to the first gripper part.

13 Claims, 8 Drawing Figures

LIFTING DEVICE FOR THE CLOSURE PLATE OF COMPRESSOR VALVES

BACKGROUND OF THE INVENTION

1. FIELD OF THE INVENTION

This invention relates to a lifting device for the closure plate of compressor valves for regulating the quanitity conveyed, with a gripper which is movably guided in the lifting direction and is acted upon in the opening direction of the closure plate by a regulating spring with tension variable by a setting device and which acts upon the closure plate by way of lifting prongs.

2. THE PRIOR ART

The object of the lifting devices used in reciprocating compressors for regulating the quantity conveyed is to delay the closure of the suction valves so that part of the medium drawn in is forced back by the piston into the suction duct. In this connection the lifting gripper participates in the lifting movements of the closure plate. During the opening of the valve the gripper strikes the lifting stop, e.g. on the catcher, whereas during the closing movement, as soon as the closure plate strikes the valve seat, it can disengage itself therefrom and swing out for the most part freely. In this connection the mass of the gripper should not exceed a certain upper limit dependent upon the structural features of the valve, so that during the shock of opening there may be no damage to or destruction of the valve. The gripper mass, however, should not be too small, as otherwise the speed of the gripper becomes too great during the closure procedure, in which the flow forces act upon the closure plate in an accelerating manner, and this in turn results in considerable stresses, in particular a hard impact of the closure plate upon the valve seat. In difficult operating conditions it can happen that the two mass limits are only a slight distance away from one another or even overlap one another, which can lead to overstressing of the lifting device and the suction valve.

German Patent No. 923 082 discloses a lifting device with a rigid gripper on which are secured sleeves in which pins acting as lifting prongs are guided. Shock-absorbing intermediate members are provided between the said pins and the sleeves, for example cylindrical pieces of soft rubber or plastics material can be inserted, stuck or vulcanized into the sleeves. The pins can be displaced independently of one another under the action of the shocks acting upon them during the regulating procedure. The stresses upon the suction valve and the lifting device itself cannot, however, be reduced in this way. It is particularly disadvantageous, however, for the closure plate not to be guided precisely during the regulating movement, so that it can be positioned obliquely under the action of the flow forces and performs a wobbly lifting movement.

SUMMARY OF THE INVENTION

The object of the present invention is to improve the lifting device in such a way that hard knocks by the lifting prongs upon the closure plate or upon the lifting stop itself are avoided, while the advantageous parallel guidance of the closure plate is ensured as in the case of the known rigid grippers.

This object is attained according to the invention in that the gripper is divided into at least two gripper parts which are displaceable relative to one another in the lifting direction and between which at least one damping spring is interposed, and the displacement path between the two gripper parts is bounded by end stops between which the damper springs are pre-tensioned, the pre-tensioning force of the damper springs being approximately as great as or greater than the regulating force of the regulating spring required for keeping the regulated valve open. By means of this design it is possible in a simple manner to select the mass of the gripper effective in each case in such a way that an optimum movement with little stressing of the parts moved is attained as the quantity conveyed is regulated. When the valve is opened only the mass of one gripper part, which can if necessary be kept small, strikes the lifting stop directly. The mass of the other gripper part, on the other hand, is spring-mounted against the mass of the first gripper part by the damper springs, as a result of which the impact force is gently absorbed. During the movement of the gripper in the closing direction of the valve, however, both the masses are rigidly connected to one another by way of the end stops, so that the velocity which occurs is limited.

On account of the pre-tensioning of the damper springs, during the regulating procedure the lifting device according to the invention first acts as a rigid gripper and effects a precise parallel guidance of the closure plate during its lifting movement. As soon as the closure plate touches the valve seat, however, the gripper moves further into the valve seat on account of its inertia. In this way the regulating spring is tensioned and causes a reversal of the direction of movement of the gripper, so that the latter is pushed back against the closure plate. In this connextion the lifting prongs act with relatively high velocity upon the closure plate which is in the closed position. The pre-tensioned damper springs then come into effect.

They absorb the impact forces and prevent a brief lifting of the closure plate which is otherwise possible against the relatively high pressure already present in the compressor. In this way energy losses are avoided, and the wear of the lifting device and the noise produced thereby are considerably reduced.

Within the scope of the invention various embodiments of the lifting device are possible. Thus one or more additional weights, which are secured to the gripper part provided with the gripper prongs, e.g. by tie screws, so as to be displaceable against the force of the pre-tensioned damper springs, may be provided as the second gripper part. This simple embodiment permits a subsequent reconstruction of rigid grippers already present, it being possible to adapt their mass effective in each case to the existing operating conditions.

In a preferred embodiment of the invention the lifting prongs are guided as a second gripper part so as to be displaceable on the other gripper part against the force of the pre-tensioned damper springs. In this connection, the gripper mass, which is not spring-mounted and is direct connection with the closure plate, can be kept particularly small, so that a substantial degree of damping is achieved.

A further simple embodiment of the invention lies in the fact that the lifting prongs or the additional weights are provided on a ring. This ring is loaded by one or more damper springs, it being possible for the end stops to be advantageously formed by one or more tie screws. It is also possible for the lifting prongs or the additional weights to be slidingly guided in bores in a pressure plate with the aid of extensions, e.g. by means of fastening screws, the damper springs being supported on the pressure plate.

In another modification of the lifting device according to the invention the lifting prongs are secured to the radially projecting arms of a gripper spider with the aid of tie screws and are guided without friction by star-shaped guide springs relative to the gripper spider. In this connection frictional forces during the movement of the lifting prongs are avoided, so that this embodiment is particularly suitable for compressors operating without lubrication. Helical springs arranged coaxially to the tie screws can be provided as the damper springs, but star shaped leaf springs can also be used.

An advantageous embodiment of the invention further lies in a gripper spider being provided with radially projecting arms to which is secured a stop ring on which the lifting prongs are guided in the peripheral direction between the arms so as to be displaceable relative to the gripper spider. This lifting device is simple to manufacture, it being possible to secure the lifting prongs on the stop ring in different ways corresponding to the requirements in each case.

It is possible to achieve friction-free guidance of the lifting prongs by there being secured to the gripper spider jointly with the stop ring an upper guide ring on one side and a lower guide ring on the other side of the arms of the said gripper spider for the guidance of the lifting prongs, between which, in the region of the lifting prongs, are provided spacer sleeves which hold fastening screws for the lifting prongs. In this connection the damper springs can consist of circular springs which are clamped together with the lower guide ring or are formed jointly with them. It is possible to pre-tension these circular springs in a simple manner by washers being inserted in the region of the lifting prongs between the latter or the lower guide ring on the one hand and the circular springs on the other hand. These washers cause a deformation fo the circular springs and therefore pre-tensioning. The magnitude of the pre-tensioning force is determined by the total thickness of the washers inserted and thus can be varied in a simple manner.

According to the invention bar-shaped bridges, which are interposed between the radially projecting arms of a gripper spider, may also be provided instead of the stop ring and the guide rings for holding and guiding the lifting prongs. In this emobdiment too the lifting prongs may be guided on the bridges in a sliding manner or without friction by spring arms. Bar-shaped leaf springs or even helical springs may be used for pre-tensioning.

Further details and advantages of the invention may be seen in the following description of embodiments illustrated in the drawings:

DETAILED DESCRIPTION OF THE PREFERRED EMBODIMENTS

Figure 1:
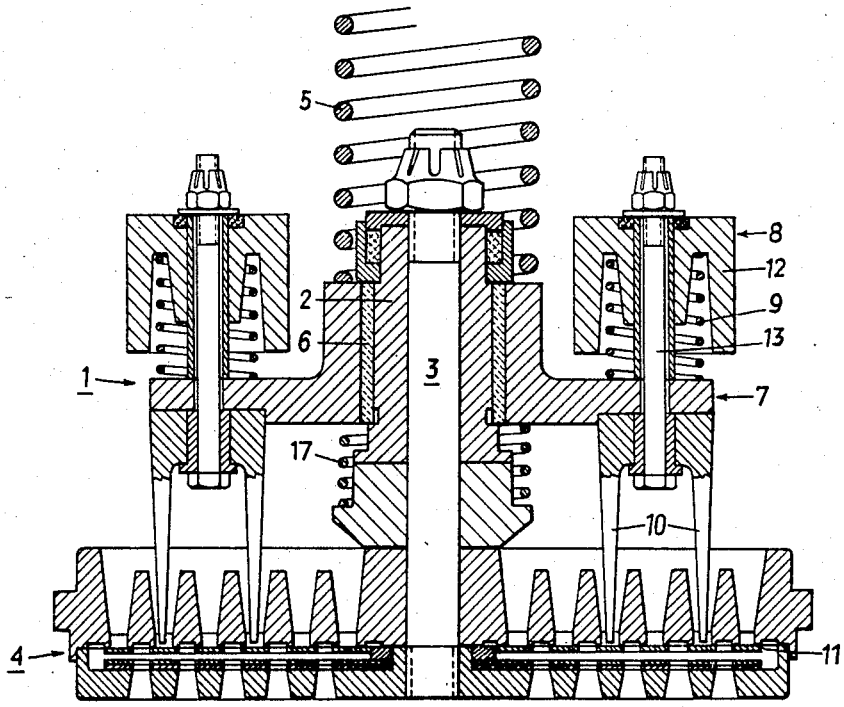
FIG. 1 is an axial central section through a valve with a lifting device according to the invention disposed thereon.
Figure 2:
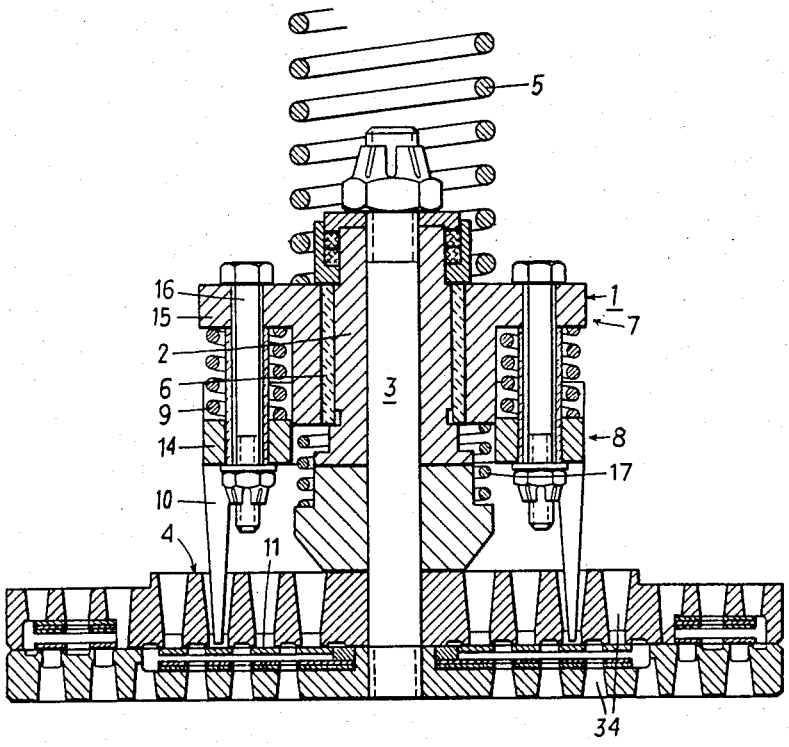
FIG. 2 is another embodiment, likewise in an axial central section.

As shown in particular in FIGS. 1 and 2, the lifting device consists of a gripper 1 which is guided axially displaceably on a cylindrical bush 2 which is secured by a screw 3 above a suction valve 4. The gripper 1 is acted upon by a regulating spring 5 which is pre-tensioned by a setting device (not shown), in order to set the quantity conveyed by the compressor desired in each case. A sliding sleeve 6 of a material with good sliding qualities is interposed between the gripper 1 and the sleeve 2. The gripper 1 is divided into two gripper parts 7 and 8 which are guided so as to be displaceable relative to one another in the lifting direction. Damper springs 9 are provided between the two gripper parts 7 and 8. The gripper 1 acts upon the closure plate 11 of the suction valve 4 by way of lifting prongs 10.

In the case of the emobdiment according to FIG. 1 the lifting prongs 10 are secured directly to one gripper part 7 by way of a flange-like extension on the latter, whereas the other gripper part 8 is formed by weights 12 which are connected to the lifting prongs 10 with the aid of tie screws 13 with the interposition of the damper springs 9. In the case of the embodiment according to FIG. 2 on the other hand, a ring 14, on which the lifting prongs 10 are provided, is displaceably guided on the outside of the gripper part 7. The helical damper springs 9 biassing the ring 14 are supported on an annular extension 15 of the gripper part 7 and are arranged distributed about the latter. The movement of the ring 14, which together with the lifting prongs 10 forms the second gripper part 8, is limited in the direction of valve 4 by tie screws 16 which form end stops. In both examples of embodiment according to FIGS. 1 and 2 the damper springs 9 are pre-tensioned by the tie screws 13 and 16 respectively in such a way that their spring force is greater than the maximum occurring regulating force of the regulating spring 5. The numeral 17 designates a return spring acting against the regulating spring 5.

Figure 3:
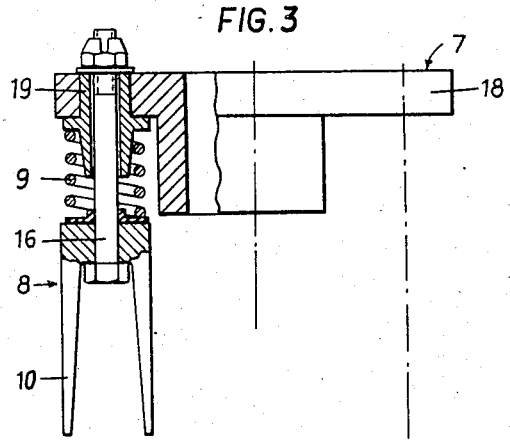
FIG. 3 is a longitudinal section in the region of the lifting prong through a slightly modified embodiment.

In the case of the modification according to FIG. 3 the lifting prongs 10 are secured to a pressure plate 18 of the gripper 1 not otherwise shown. Bores, in which guide sleeves 19 are inserted, are provided, distributed over the periphery, in the pressure plate 18 which can be made star-shaped. A screw 16, which holds a lifting prong 10 and also forms an end stop for the movement of the latter in the direction of the closure plate, is inserted in each guide sleeve 19. A pre-tensioned damper spring 9 is placed around each screw 16. The lifting prongs 10 can also be secured to the pressure plate 18 by two screws in each case, rotation also being prevented.

Figure 4:
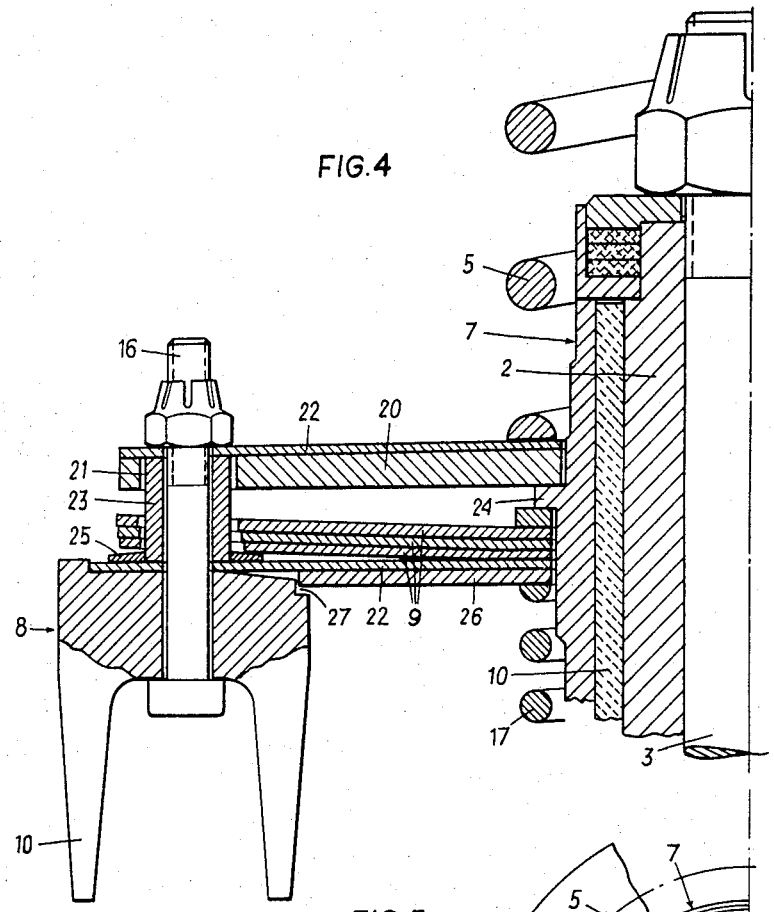
FIG. 4 is a similar longitudinal section through a further embodiment.
Figure 5:
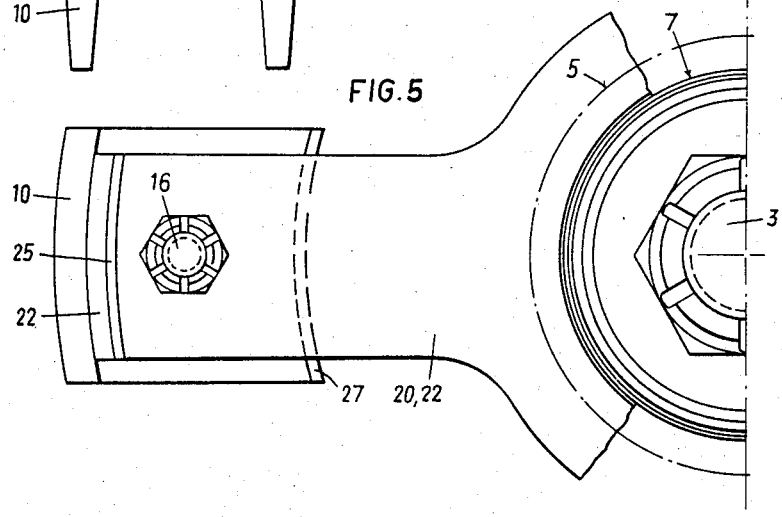
FIG. 5 is a plan view of the embodiment depicted in FIG. 4.

FIGS. 4 and 5 show an embodiment in which the lifting prongs 10 are secured to the radially projecting arms of a gripper sprider 20 with the aid of tie screws 16. The tie screws 16 pass through bores 21 of the gripper spider 20 with a relatively large degree of clearance and are held by star-shaped guide springs 22, of which one is disposed above the gripper spider 20 and a second guide spring 22 is disposed at some distance below the gripper spider 20. A spacer sleeve 23, through which the screw 16 passes, is interposed between the two guide springs 22. In this connection the damper springs 9 consist of star-shaped leaf springs which are clamped by a central hub between a collar 24 of the gripper 1 and the lower guide spring 22. The pre-tensioning is effected by washers 25 which are inserted around the tie screws 16 between the lower guide spring 22 and the ends of the star-shaped damper springs 9. In order to centre the lifting prongs 10 and prevent them from rotating, a centering disc 26, which engages in a groover 27 in the lifting prongs 10, can be clamped below the lower guide spring 22.

Figure 6:
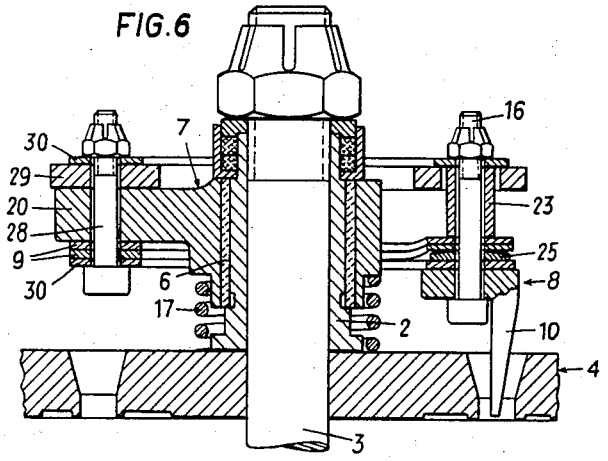
FIG. 6 is a modified embodiment of the lifting device according to the invention in an axial central section.
Figure 7:
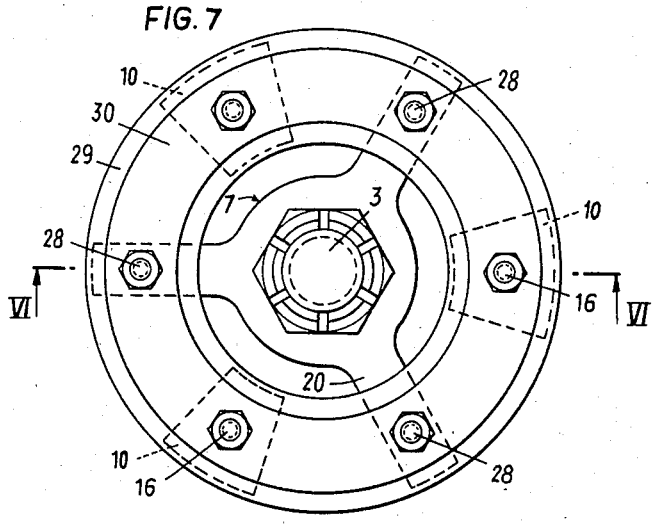
FIG. 7 is a plan view of the embodiment depicted in FIG. 6.

FIGS. 6 and 7 show an embodiment in which the gripper 1 consists of a gripper spider 20 with three radially projecting arms, as may be seen in FIG. 7. A stop ring 29, above which an upper guide ring 30 is clamped, is secured to the arms of the gripper spider 20 with the aid of screws 28. Two annular damper springs 9 and a lower guide ring 30 are clamped below the gripper spider 20 by means of the screws 28. The lifting prongs 10 are held displaceably in the peripheral direction between the arms of the gripper spider 20 by the guide rings 30 to which they are secured with the aid of tie screws 16 and one spacer sleeve 23 in each case as in the case of the example of embodiment according to FIG. 4. The spacer sleeves 23 pass through bores in the stop ring 29 with clearance. Washers 25, which are clamped between the spacer sleeve 23 and the lower guide ring 30 in the case of this example of embodiment, are provided for pre-tensioning the annular damper springs 9.

Figure 8:
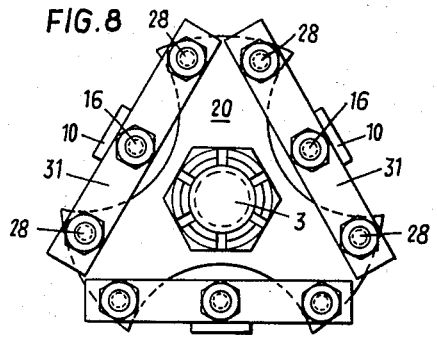
FIG. 8 is a plan view of a further embodiment of the invention.

The embodiment according to FIG. 8 differs from the design according to FIGS. 6 and 7 by the fact that bar-shaped bridges 31 are arranged on the guiding spider 20 instead of the stop ring provided there. The ends of the bridges 31 are secured to the arms of the gripper spider 20 by means of screws 28 and their central part holds the lifting prongs 10 which are secured to the bridges 31, in the same way as in the embodiment according to FIG. 6, with the aid of tie screws 16 which also form the end stop for the damper springs. These may consist of bar-shaped leaf springs, of cup springs, helical springs or even of spring bushings of plastics materials or the like.

The lifting device described and illsutrated is used to regulate the conveyed quanitity of compressors by forcibly holding open the closure plate. In all embodiments of the invention the gripping device 1 consists of two gripping parts 7 and 8 that can be moved with respect to each other and are kept at a distance from each other by the damping springs 9. This gripping device 1 should be as light as possible for some operating situations in controlling the compressor valve—that is, its overall bulk should be small—but the gripping device 1 should have as big a mass as possible for other operating situations. These two requirements conflict with each other, and therefore an advantageous compromise must be found. Such a compromise is the object of the present invention. As is evident from FIGS. 1 and 2, the gripper 1 is pressed downwardly by pre-tensioning the regulating spring 5, the lifting prongs 10 lifting the closure plate 11 from the valve seat of the valve 4. As the medium flows back through the through ducts 34 of the valve 4, flow forces, which increase with the flow velocity, act upon the closure plate 11. As soon as these flow forces exceed the force of the regulating spring 5 the closure plate 11 is pressed, moving at the same time the gripper 1, against the valve seat, which it strikes relatively hard. During this closing movement the closure plate 11 is precisely guided by the gripper 1, as the lifting prong 10 is acted upon by the pre-tensioned damper springs 9 with a greater force than the maximum occurring regulating force of the regulating spring 5. In this connection the gripper 1 acts as a rigid type of gripper.

After striking the closure plate 11 on the valve seat the gripper moves further by a slight amount on account of its inertia, until the regulating spring 5 pushes it back again. The lifting prongs 10, which have first of all been released from the closure plate 11, then strike the closure plate 11 in the opening direction. In the case of a rigid gripper the impact force occurring then could cause momentary opening of the valve, so that energy losses, noise and considerable stresses would occur. In the case of the lifting device according to the invention, however, these impact forces are absorbed by the pre-tensioned damper spring 9, so that the disadvantages otherwise arising during the collision of the gripper are avoided or at least considerably reduced. The pre-tensioning force of the damper springs 9 present as a whole must be greater than the maximum occurring regulating force of the regulating spring 5, so that it can certainly not be overcome during the closing movement. On the other hand, however, the pre-tensioning force should not be substantially greater than necessary, so that the gripper may be cushioned as gently as possible during collision. The precise magnitude of the pre-tensioning force required in each case of application can be calculated or determined by trial and error.

Stated in different words, when controlling the quantity of fluid medium delivered by the compressor, the gripper 1 with the lifting prongs 10 is moved together with the closure plate 11—that is, very rapidly. The closure plate 11 is first held open by the gripper 1 because of the force of the regulating spring 5 for the part of the piston stroke of the compressor (not shown in the drawings) until the kinetic energy that is applied to the closure plate 11 by the fluid medium that is flowing through the valve overcomes the force of the regulating spring 5. The closure plate 11 is then moved towards the valve seat—that is, upwardly, in FIG. 1—and impacts against the valve seat. In this movement phase, the gripper 1 should have as big a mass as possible, so that it is not accelerated too fast by the kinetic energy and, furthermore, so that it can guide the closure plate 1 exactly parallel during that movement.

When the closure plate 11 impacts against the valve seat, its movement is stopped. However, because of its inertia, the gripper 1 moves on, and as it does the force of the regulating spring 5 causes a reversal of the movement of the gripper 1A. As a result, the gripper 1 is moved back towards the closure plate 11—that is, downwardly in FIG. 1. The lifting prongs 10 strike the closure plate 11.

If the relatively heavy gripper 1 consists of a single piece—that is, if the gripper parts 7 and 8 are connected together rigidly—the entire weight of the heavy gripper 1 acts upon the closure plate 11 and lifts it off the valve seat and against the kinetic forces for a brief period. This is disadvantageous and its avoidance is one of the objects of the present invention.

In accordance with the invention, the gripper 1 has two parts. When the lifting prongs 10 strike the closure plate 11 as shown in FIG. 1, only the mass of the gripper part 7 is stopped immediately. The mass of the gripper part 8 can move further downwardly against the force of the damping springs 9. Thus, the damping springs 9 absorb the kinetic energy of the second gripper part 8 and cushion that movement. Thus, in the so-called backward swinging of the gripper 1, the entire mass of the gripper 1 does not act upon the closure plate 11, but a part of the mass of the gripper—specifically, the mass of the gripper part 8—is absorbed by the damping springs 9. The undesirable lifting of the closure plate 11 off of the valve seat can thus be prevented.

The way of functioning that has been described holds good for all depicted embodiments of the invention. The difference between the individual embodiments consists only in the fact that the gripper 1 is divided up into its two gripper parts 7 and 8 in different ways. In all embodiments, the gripper 1 is the part on which the regulating spring 5 acts and the gripper part 7 by means of the damping springs 9. In FIG. 1, the lifting prongs 10 are attached to the gripper part 7 and the gripper part 8 is a movable absorption means. In FIG. 2, the gripper part 8 includes a ring 14 to which the lifting prongs 10 are attached. In the embodiment shown in FIG. 3, on the other hand, the lifting prongs 10 themselves are the gripper part 8. In FIGS. 4 through 8, gripper part 7 is star-shaped and the gripper part 8 is positioned against the gripper part 7 in such a way that it can move.

In all embodiments, the way of functioning and the action that is obtained are practically the same. The damping spring 9 is more rigid than the regulating spring 5 in all embodiments, so that the damping spring 9 does not come into action at all when the closure plate 11 is lifted off of the valve seat. Only when the valve closes and there is impacting against the valve seat does the damping spring 9 bring about an absorption of the backward movement of the gripper 1, and that is accomplished by having only one of the gripper parts—the gripper part 7 shown in FIG. 1 and the gripper part 8 shown in the other embodiments—stopped immediately when the lifting prongs 10 strike the closure plate while the other gripper part 8 or 7 can pivot farther out against the power of the damping spring 9.

I claim:

1. A lifting device for controlling the movement of the closure plate of a compressor valve, said compressor valve defining an axis line therethrough and providing a valve seat therein, said closure plate, when moved in a first direction along said axis line due to fluid pressure within said compressor valve, becoming seated in said valve seat to shut off fluid flow therethrough, and when moved in a second direction along said axis line, allowing fluid to pass through said valve seat, said lifting device comprising a first gripper part which is connectable to said compressor valve so as to be movable toward and away from said compressor valve along said axis line, a regulating spring in contact with said first gripper part to bias said first gripper part toward said compressor valve, and a second gripper part which comprises a plurality of lift elements having lifting prongs which can contact said closure plate to move it in said second direction away from said valve seat, a plurality of tension screws which movably mount said lift elements with respect to said first gripper part and provide end stops to control the distance said lift elements can move relative to said first gripper part, and a plurality of damper springs for damping the relative movement of said lift elements relative to said first gripper part.

2. A lifting device according to claim 1, wherein the lifting prongs are secured to the radially projecting arm of a gripper spider with the aid of tie screws and are guided without friction by star-shaped guide springs relative to the gripper spider.

3. A lifting device according to claim 2, wherein the damper springs are star-shaped leaf springs.

4. A lifting device according to claim 1, wherein said first gripper part comprises a gripper spider which is provided with radially projecting arms to which is secured a stop ring on which the lifting prongs are guided in the peripheral direction between the arms so as to be displaceable relative to the gripper spider.

5. A lifting device according to claim 4, including secured to the gripper spider jointly with the stop ring an upper guide ring on one side and a lower guide ring on the other side of the arms of the said gripper spider for the guidance of the lifting prongs, between which, in the region of the lifting prongs, are provided spacer sleeves which hold fastening screws for the lifting prongs.

6. A lifting device according to claim 5, wherein the damper springs consist of circular springs which are clamped together with the lower guide ring or are formed jointly with them.

7. A lifting device according to claim 6, wherein, in order to pretension the circular springs, washers are provided in the region of the lifting prongs between the latter or the lower guide ring and the circular springs.

8. A lifting device according to claim 1, wherein the lifting prongs are secured and displaceably guided on barshaped bridges, which are interposed between the radially projecting arms of a gripper spider.

9. A lifting device for controlling the movement of the closure plate of a compressor valve, said compressor valve defining an axis line therethrough and providing a valve seat therein, said closure plate, when moved in a first direction along said axis line due to fluid pressure within said compressor valve, becoming seated in said valve seat to shut off fluid flow therethrough, and when moved in a second direction along said axis line, allowing fluid to pass through said valve seat, said lifting device comprising a first gripper part which is connectable to said compressor valve so as to be movable toward and away therefrom along said axis line, said first gripper part including a radially-extending flange, said flange having a first side facing said compressor valve and a second side facing away from said compressor valve, a regulating spring positioned against said first gripper part to bias said first gripper part toward said compressor valve, and a second gripper part which is movably mounted on the flange of said first gripper part so as to be movable toward and away from said compressor valve in parallel with said axis line, said second gripper part including a lift element located on the first side on said flange, said lift element including prongs which can contact said closure plate to move it in said second direction away from said valve seat; a weight means located on the second side of said flange; tie screws which extend through said flange around the circumference thereof and which connect said lift element with said weight means, said weight means being mounted to be axially movable along said tie screws, and damper springs mounted around said tie screws and between said flange and said weight means to bias said weight means away from said flange, the combined forces of said damper springs being at least as great as the force applied by said regulating spring against said first gripper part.

10. A lifting device as defined in claim 1, wherein said first gripper part includes a radially-extending flange having bores therethrough, wherein said tension screws of said second gripper part extend through respective bores in said flange, wherein said lift elements of said second gripper part are located between said flange and said compressor valve and are connected to respective tension screws, wherein said second gripper part includes a plurality of weight means which are respectively connected to said tension screws on the side of said flange opposite said compressor valve, and wherein said damper springs are positioned around respective tension screws and between respective weight means and said flange.

11. A lifting device according to claim 10, werein said lifting prongs or said weight means are provided on a ring.

12. A lifting device according to claim 10, wherein said lifting prongs or said weight means are slidingly guided in bores in a pressure plate with the aid of said tension screws, the damper springs being supported on the pressure plate.

13. A lifting device as defined in claim 1, wherein said first gripper part includes a radially-extending flange having bores therethrough, wherein said tension screws of said second gripper part extend through respective bores in said flange, wherein said lift elements of said second gripper part are located between said flange and said compressor valve and are connected to respective tension screws, and wherein said damper springs are positioned around respective tension screws between each respective lift element and said flange.

* * * * *